US009281148B2

(12) United States Patent
Enomoto

(10) Patent No.: US 9,281,148 B2
(45) Date of Patent: Mar. 8, 2016

(54) CONTACT DEVICE

(75) Inventor: Hideki Enomoto, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/002,331

(22) PCT Filed: Mar. 9, 2012

(86) PCT No.: PCT/JP2012/056137
§ 371 (c)(1),
(2), (4) Date: Aug. 29, 2013

(87) PCT Pub. No.: WO2012/128080
PCT Pub. Date: Sep. 27, 2012

(65) Prior Publication Data

US 2013/0335177 A1 Dec. 19, 2013

(30) Foreign Application Priority Data

Mar. 22, 2011 (JP) ..... 2011-063238

(51) Int. Cl.

| | |
|---|---|
| ***H01H 63/02*** | (2006.01) |
| ***H01H 67/02*** | (2006.01) |
| ***H01H 51/00*** | (2006.01) |
| ***H01H 1/20*** | (2006.01) |
| ***H01H 1/54*** | (2006.01) |
| ***H01H 50/42*** | (2006.01) |

(52) U.S. Cl.
CPC ..... *H01H 51/00* (2013.01); *H01H 1/20* (2013.01); *H01H 1/54* (2013.01); *H01H 50/42* (2013.01)

(58) Field of Classification Search
CPC ..... H01H 1/20; H01H 51/00; H01H 50/42; H01H 1/54
USPC ..... 335/126, 133, 185, 189, 192–194
See application file for complete search history.

(56) References Cited

U.S. PATENT DOCUMENTS

| | | | | |
|---|---|---|---|---|
| 5,892,194 | A * | 4/1999 | Uotome et al. | 218/68 |
| 6,700,466 | B1 | 3/2004 | Yamamoto et al. | |
| 7,859,373 | B2 * | 12/2010 | Yamamoto et al. | 335/126 |
| 7,911,301 | B2 * | 3/2011 | Yano et al. | 335/131 |

(Continued)

FOREIGN PATENT DOCUMENTS

| | | |
|---|---|---|
| JP | S40-17149 | 6/1965 |
| JP | 55-29982 S | 7/1980 |

(Continued)

OTHER PUBLICATIONS

International Search Report issued in PCT/JP2012/056137 with Date of mailing May 15, 2012.

*Primary Examiner* — Bernard Rojas
(74) *Attorney, Agent, or Firm* — McDermott Will & Emery LLP

(57) ABSTRACT

An electromagnet device is configured to generate a magnetic attractive force between a stationary core and a movable core when electricity is applied to a coil, so that the movable core is moved in a direction for coming into contact with the stationary core, and a movable shaft is moved in a direction in which a first end face of the movable shaft separates from a movable terminal. After the movable contact comes in contact with the fixed contact, the movable core moves further in a direction for coming into contact with the stationary core. A yoke made of a magnetic body is disposed between the movable terminal and the first end of the movable shaft.

10 Claims, 11 Drawing Sheets

(56) References Cited

U.S. PATENT DOCUMENTS

| | | | | |
|---|---|---|---|---|
| 8,138,863 | B2 | 3/2012 | Tanaka et al. | |
| 8,390,410 | B2 | 3/2013 | Kojima et al. | |
| 8,816,803 | B2 * | 8/2014 | Naka et al. | 335/196 |
| 8,823,472 | B2 * | 9/2014 | Takaya et al. | 335/133 |
| 2009/0096559 | A1 * | 4/2009 | Yano | H01H 9/443 335/187 |
| 2009/0322454 | A1 * | 12/2009 | Tanaka et al. | 335/189 |
| 2010/0289604 | A1 | 11/2010 | Kojima et al. | |

FOREIGN PATENT DOCUMENTS

| | | | |
|---|---|---|---|
| JP | 60-163658 | S | 10/1985 |
| JP | 2001-118450 | A | 4/2001 |
| JP | 2007-109470 | A | 4/2007 |
| JP | 2008-226547 | A | 9/2008 |
| JP | 2010-010056 | A | 1/2010 |
| JP | 2010-267470 | A | 11/2010 |
| WO | WO 2012014368 | A1 * | 2/2012 |

* cited by examiner

CONTACT DEVICE

RELATED APPLICATIONS

This application is the U.S. National Phase under 35 U.S.C. §371 of International Application No. PCT/JP2012/056137, filed on Mar. 9, 2012, which in turn claims the benefit of Japanese Application No. 2011-063238, filed on Mar. 22, 2011, the disclosures of which are incorporated by reference herein.

TECHNICAL FIELD

This invention relates to a contact device.

BACKGROUND ART

Conventionally, a plunger type contact device B1 as shown in FIG. 15 is known (see for example Patent Document 1), which has a solenoid 102 configured to attract a plunger 102*b* due to magnetizing a stationary core 102*a* by applying electricity to a magnet coil 101. It has a pair of fixed contacts 103 that are connected to an external electric circuit. Furthermore, a movable contact 104 that is driven by the solenoid 102 so as to connect and disconnect the pair of fixed contacts 103 therethrough is disposed with a predetermined gap on the side opposite to the plunger relative to the pair of fixed contacts 103. The movable contact 104 is biased toward the fixed contacts by a pressing spring 105. Also, a space 107*a* which the fixed contacts 103 and the movable contact 104 are put in and a space 107*b* which the solenoid 102 is put in are separated by a diaphragm 106. Furthermore, at the center portion of the diaphragm 106, a bush 108 is inserted and fixed to the diaphragm 106. The bush 108 is disposed between the plunger 102*b* and the movable contact 104.

The bush 108 moves integrally with the movable contact 104 by a reactive force of a pressing spring 105, when the plunger 102*b* moves due to being attracted by the stationary core 102*a*, until the movable contact 104 moves to come in contact with the pair of fixed contacts 103. After the movable contact 104 comes in contact with the fixed contacts 103, the plunger 102*b* moves by itself separated from the bush 108 until it collides against the stationary core 102*a*.

Also, in order to switch bidirectional currents of different magnitudes between conduction and cut-off, a plunger type contact device B2 as shown in FIG. 16 has been proposed (see for example Patent Document 2). The contact device B2 has a coil 201 that generates magnetic force by applying electricity, a pair of contact portions 202 that open and close in response to the magnetic force, and magnets 210 that are respectively disposed outside the pair of contact portions 202 adjacent thereto for extinguishing an arc by stretching the arc generated at the contact portions 202.

The pair of contact portions 202 have a pair of fixed holders 202*a* and a movable holder 202*b*. The fixed holders 202*a* are made of conductors that respectively hold the pair of fixed contacts 202*c*. The movable holder 202*b* is made of a conductor that advances and retreats with respect to the fixed holders 202*a* by a magnetic force generated by the coil 201, and a pair of movable contacts 202*d* are formed on the movable holder 202*b* so as to face the pair of fixed contacts 202*c*.

Also, in order to extinguish an arc generated between the contacts in a short time, the magnets 210 for extinguishing an arc are provided, and an arc generated between the contacts is stretched by the magnets 210 for extinguishing an arc.

A movable core 203 is attracted toward a stationary core 204 by a magnetic flux that is generated when electricity is applied to the coil 201, and a shaft 205 and an insulator 206 attached integrally to the movable core 203 move together with the movable core 203. The movable holder 202*b* moves toward the fixed holder 202*a* together with the movable core 203 by means of a holder biasing means 205, and thereby the pair of movable contacts 202*d* come in contact with the pair of fixed contacts 202*c*.

After the movable contacts 202*d* come in contact with the fixed contacts 202*c*, since the movable core 203 continues to be attracted toward the stationary core 204, the movable holder 202*b* and the movable core 203 are separated from each other at this time. Thereafter, the movable core 203 moves to the position where the lower end of the shaft 205 comes into contact with a bottom portion 207 provided inside the stationary core 204, and then comes to stop. At this time, the movable holder 202*b* is pressed toward the fixed holder 202*a* by the holder biasing means 205, the movable contact 202*d* is kept in contact with the fixed contact 202*c*, and a conduction state is formed between the contacts.

CITATION LIST

Patent Literature

Patent Document 1: JP 2007-109470A
Patent Document 2: JP 2010-267470A

SUMMARY OF INVENTION

Technical Problem

In the conventional contact device described above, if a failure such as a short circuit or the like occurs at an external circuit connected to the fixed contact, a short circuit current flows between the fixed contact and the movable contact. Therefore, there is a concern that a pressing pressure between the movable contact and the fixed contact is reduced and the contacts are separated from each other due to an electromagnetic repulsive force caused by the short circuit current, and that an arc may be generated between the fixed contact and the movable contact, and as a result heat is generated and the contacts are welded together.

The present invention is made in the light of the above-described circumstances, and an object of the present invention is to provide a contact device that includes a configuration in which a movable core moves in a direction for coming into contact with a stationary core after a movable contact has come in contact with a fixed contact, and that can cancel out the repulsive force between the contacts, and suppress the reduction of the pressing pressure between the contacts.

Solution to Problem

In order to solve the above problem, the contact device includes a movable core and a stationary core. The movable core is configured to move in a direction for coming into contact with the stationary core, and accordingly, a movable contact comes in contact with a fixed contact. It is configured that, after the movable contact comes in contact with the fixed contact, the movable core further moves in the direction for coming into contact with the stationary core. The contact device includes a movable terminal and a movable shaft. The movable terminal has the movable contact. The movable shaft is configured to move in the axis direction thereof along with the movement of the movable core. Moreover, the contact device has a first yoke. The first yoke has a magnetic body. The first yoke is disposed between the movable terminal and the movable shaft.

Moreover, the movable shaft has a first end face that faces the movable terminal. In this case, it is preferable that the first yoke is disposed between the movable terminal and a first end of the movable shaft that moves in the axis direction along with the movement of the movable core.

Moreover, the contact device is a contact device configured so that the movable core, after the movable contact comes in contact with the fixed contact by moving the movable core in the direction for coming into contact with the stationary core, moves further in the direction for coming into contact with the stationary core. The first yoke made of a magnetic body is disposed between the movable terminal on which the movable contact is provided and the first end of the movable shaft, where the first end face of the movable shaft faces the movable terminal and the movable shaft moves in the axis direction along with the movement of the movable core.

In the present invention, the movable terminal is located at a first side relative to the fixed contact so that the movable contact contacts and separates from the fixed contact, and a second end of the movable shaft extends in a second side relative to the fixed contact. It is preferable to include: an electromagnet device that includes the movable core located at the second side relative to the movable shaft, and the stationary core located at the second side relative to the movable core, the electromagnet device being configured, by generating a magnetic attractive force between the stationary core and the movable core to move the movable core in the direction for coming into contact with the stationary core, to move the movable shaft in a direction in which the first end face of the movable shaft separates from the movable terminal; and a pressing spring that biases the movable terminal in a direction in which the movable contact comes into contact with the fixed contact.

In the present invention, the first yoke is preferably provided at the movable terminal.

In the present invention, the first yoke is preferably provided at a member on which the fixed contact is formed.

In the present invention, the first yoke is preferably provided at the movable shaft.

In the present invention, the first yoke preferably includes first yokes that are provided at a member on which the fixed contact is formed and at the movable terminal.

In the present invention, the fixed contact is preferably connected to a conduction plate that extends in the same direction as the moving direction of the movable terminal.

In the present invention, the fixed contact is preferably connected to a conduction plate that is extended in a direction that is perpendicular to the moving direction of the movable terminal.

In the present invention, it is preferable that the contact device includes a plurality of fixed contacts arranged side by side, and a pair of permanent magnets that are respectively arranged on extended lines extending from both ends of a line segment, the line segments connecting a pair of the fixed contacts located at the two ends of this side by side arrangement of the fixed contacts.

In the present invention, it is preferable that the contact device includes a plurality of fixed contacts arranged side by side, and that a pair of permanent magnets which are arranged opposite to each other with the fixed contacts sandwiching therebetween are formed along the direction of side by side arrangement of the fixed contacts.

In the present invention, it is preferable that the same poles of the pair of permanent magnets oppose each other.

In the present invention, it is preferable to further include a second yoke made of a magnetic body that magnetically connects the pair of permanent magnets.

Advantageous Effects of Invention

As described above, the device of the present invention includes a configuration in which after a movable contact comes in contact with a fixed contact, a movable core moves further in a direction for coming into contact with a stationary core, and has an effect that can cancel out a repulsive force between the contacts, and can suppress a reduction of a pressing force between the contacts.

DESCRIPTION OF EMBODIMENTS

In the following, embodiments of the present invention will be described based on the drawings.

(First Embodiment)

Figure 1:
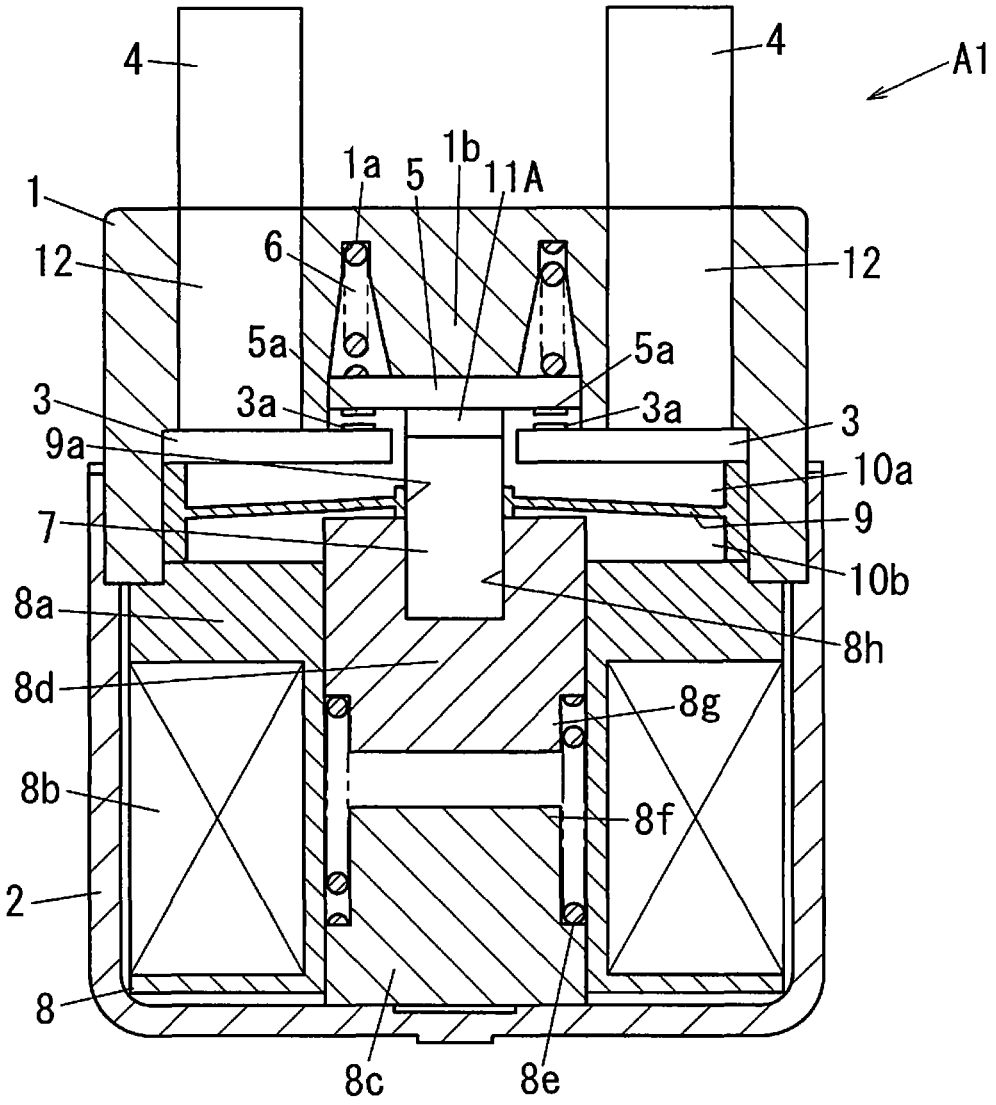
FIG. 1 is a cross-section illustrating a configuration of a contact device according to a first embodiment.

FIG. 1 illustrates a configuration of a contact device A1 according to the present embodiment. Note that, in the following description, the directions of up, down, left, right, front, and back are defined as in FIG. 1.

In the contact device A1, an outer wall is constituted by: a box-shaped case 2 that has an opening in its upper face; and a box-shaped contact cover 1 that has an opening on its lower face and covers therewith an upper portion of the box-shaped case 2.

A pair of fixed holders 3 on which fixed contacts 3*a* are respectively provided on their upper faces are accommodated in the contact cover 1. The pair of fixed holders 3 are arranged side by side in the right-left direction, and thereby the pair of fixed contacts 3*a* are arranged side by side in the right-left direction. The pair of fixed holders 3 are connected respectively to a pair of conduction plates 12 that extend in the up-down direction, and are connected respectively to a pair of terminals 4 that are attached to the upper face of the contact cover 1 through the respective conduction plates 12. The pair of terminals 4 are connected to an external circuit (not shown). In the embodiment, the fixed contacts 3*a* are provided near the front ends (near the tips) of the respective fixed holders 3.

Furthermore, a movable terminal 5 is disposed opposite to the upper face of the fixed holders 3. The movable terminal 5 is provided on its lower surface with movable contacts 5*a* that face the pair of fixed contacts 3*a*. The contact cover 1 has a toric recess 1*a* at the bottom face thereof. A pressing spring 6 is fitted in the recess 1*a* so that the lower end of the pressing spring 6 is in contact with the upper face of the movable terminal 5.

A yoke 11A (first yoke) is provided integrally at the movable terminal 5. The yoke 11A is made of a magnetic body, for example, a soft iron to have a tabular shape, and is provided approximately at the center of the lower face of the movable terminal 5 (between the pair of movable contacts 5*a*). The lower face of the yoke 11A faces the upper end face of a columnar movable shaft 7. The movable shaft 7 extends downward between the pair of fixed holders 3, and an electromagnet device 8 is disposed at the lower end side of the movable shaft 7.

Furthermore, a diaphragm 9 is placed on an opening edge of the contact cover 1, and thereby the diaphragm 9 separates a contact space 10*a* in the contact cover 1 and an electromagnet space 10*b* in the case 2. The fixed holders 3, the movable terminal 5, the pressing springs 6, and the conduction plates 12 are put in the contact space 10*a*, and the electromagnet device 8 is put in the electromagnet space 10*b*.

The diaphragm 9 is shaped like a disk having an insertion hole 9*a* at the center portion in the radial direction. An outer circumferential portion of the diaphragm 9 is in close contact with and fixed to an inner circumferential face of the contact cover 1. The movable shaft 7 is inserted in the insertion hole 9*a*, and the movable shaft 7 is fixed to an inner circumferential portion of the insertion hole 9*a*. This diaphragm 9 separates the contact space 10*a* from the electromagnet space 10*b*, and has the function to prevent an abrasion powder in the contact space 10*a* from intruding into the electromagnet space 10*b*, and to prevent foreign objects in the electromagnet space 10*b* from intruding into the contact space 10*a*.

The electromagnet device 8 is configured by a coil bobbin 8*a*, a coil 8*b*, a stationary core 8*c*, a movable core 8*d*, and a return spring 8*e*.

The coil bobbin 8*a* is made of an insulation member to have a shape like a cylinder tube, and the coil 8*b* is wound around the outer circumference thereof. The stationary core 8*c*, the movable core 8*d*, and the return spring 8*e* are accommodated in the tube-shaped coil bobbin 8*a*, and the movable core 8*d* is disposed above the stationary core 8*c* so as to face the stationary core 8*c*. A columnar protrusion 8*f* is formed on the upper face of the stationary core 8*c*, a columnar protrusion 8*g* is formed on the lower face of the movable core 8*d*, and respective two ends of the return spring 8*e* are fitted to the protrusions 8*f* and 8*g*. Furthermore, the case 2 that accommodates the electromagnet device 8 is made of a magnetic body, and functions as a yoke that forms a magnetic circuit. The stationary core 8*c* is disposed so that its lower face is in contact with the bottom face of the case 2. Moreover, the movable core 8*d* has a recess 8*h* that is circular in cross-section and that is formed approximately at the center of the upper face, and the lower end of the movable shaft 7 is slidably inserted in this recess 8*h*.

Next, an operation of the contact device A1 will be described.

First, when no current is applied to the coil 8*b*, the movable core 8*d* has moved upward by the spring force of the return spring 8*e* against the spring force of the pressing spring 6, and has moved the movable terminal 5 upward through the movable shaft 7. At this time, the upper face of the movable terminal 5 is kept in contact with a columnar protrusion 1*b* that is formed on the inner circumference side of the recess 1*a*, and the movable contacts 5*a* are kept out of contact from the fixed contacts 3*a*.

When current is applied to the coil 8*b* through a terminal (not shown) that is placed out of the contact cover 1, the stationary core 8*c* is magnetized and functions to be an electromagnet, and accordingly a magnetic attractive force acts between the stationary core 8*c* and the movable core 8*d*. Thus, the movable core 8*d* moves in the direction for coming into contact with the stationary core 8*c* (downward) against the spring force of the return spring 8*e*. When the movable core 8*d* moves downward, since the force that presses the movable terminal 5 to the protrusion 1*b* through the movable shaft 7 is relieved, the movable terminal 5 moves downward by the spring force of the pressing spring 6, and thereby the movable contacts 5*a* respectively come in contact with the fixed contacts 3*a*. After the movable contacts 5*a* have come in contact with the fixed contacts 3*a*, the movable core 8*d* moves downward further by itself until the lower face of the movable core 8*d* comes in contact with the upper face of the stationary core 8*c* and stops. At this time, the movable contacts 5*a* are pressed toward the fixed contacts 3*a* by being subject to the spring force of the pressing spring 6.

When no more current is applied to the coil 8*b* and the attractive force of the electromagnet disappears, the movable core 8*d* moves in the direction for separating from the stationary core 8*c* (upward) by the spring force of the return spring 8*e*. The movable core 8*d* collides with the lower face of the movable shaft 7, and then the movable core 8*d* and the movable shaft 7 move upward together. As a result, the movable terminal 5 moves upward together with the movable shaft 7 against the spring force of the pressing spring 6, and accordingly the movable contacts 5*a* separate from the fixed contacts 3*a*. After separating from the fixed holders 3, the movable terminal 5 moves upward further by being pressed by the movable shaft 7, and comes in contact with the lower end face of the protrusion 1*b* and stops.

In such contact device A1, the movable contacts 5*a* are made contact with the fixed contacts 3*a* by applying a current to the coil 8*b*. In this state, if a failure such as a short circuit or the like occurs between the terminals 4 that are brought out from the fixed contacts 3*a*, a short circuit current flows between the fixed contacts 3*a* and the movable contacts 5*a*. Therefore in such device, there is a concern that a pressing pressure between the movable contacts 5*a* and the fixed contacts 3*a* are reduced and the contacts are separated due to the electromagnetic repulsive force caused by the short circuit current, and that an arc may be generated between the fixed contacts 3*a* and the movable contacts 5*a*, and as a result heat is generated and the contacts are welded together.

Thus, in the present embodiment, a tabular yoke 11A made of a magnetic body is integrally provided approximately at the center of the lower face of the movable terminal 5. Therefore, as shown in FIG. 2, the yoke 11A provided on the lower face of the movable terminal 5 disturbs the balance of the magnetic field generated around the movable terminal 5 in a state in which a current flows between the movable contacts 5*a* and the fixed contacts 3*a*.

Figure 2:
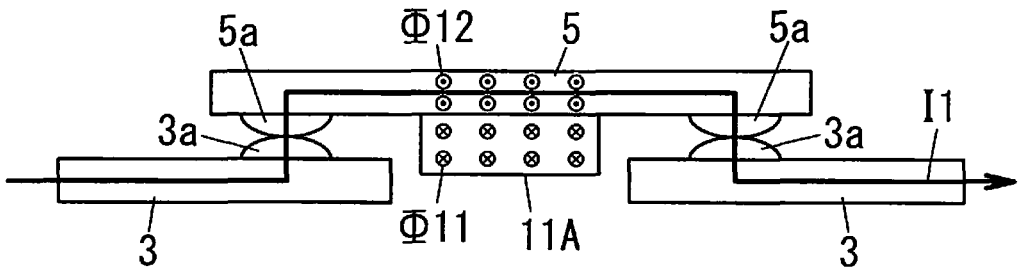
FIG. 2 is a front view illustrating a schematic configuration in the vicinity of a contact portion of the contact device according to the first embodiment.

Describing this more specifically, when a current I1 between the contacts flows from the left to the right in FIG. 2, the magnetic flux Φ11 that runs from the front to the back, from among the magnetic flux generated around the movable terminal 5, is mostly present in the yoke 11A, and the magnetic flux Φ11 that passes through the movable terminal 5 is reduced. Meanwhile, the magnetic flux Φ12 that runs from the back to the front, from among the magnetic flux generated around the movable terminal 5, is shifted downward as a whole, and the magnetic flux Φ12 that passes through the movable terminal 5 increases.

Therefore, the downward electromagnetic force that acts on the movable terminal 5 caused by the magnetic flux Φ12 that runs from the back to the front in the movable terminal 5 becomes larger than the upward electromagnetic force that acts on the movable terminal 5 caused by the magnetic flux Φ11 that runs from the front to the back in the movable terminal 5. Thus, the movable terminal 5 is subject to a downward electromagnetic force (attractive force). Since this downward electromagnetic force is a force that acts in a direction 180 degree opposite to the repulsive force between the contacts (upward force) generated in the movable terminal 5, it acts in the direction in which the repulsive force between the contacts is most effectively canceled.

Thus, in the contact device A1 of the present embodiment, even if a short circuit current flows between the fixed contacts 3*a* and the movable contacts 5*a*, the electromagnetic force described above can effectively cancel out the repulsive force between the contacts, and accordingly the reduction of the pressing force between the contacts can be suppressed. Therefore, generation of an arc between the movable contacts 5*a* and the fixed contacts 3*a*, heat generation, and welding between contacts can be suppressed.

Figure 3:
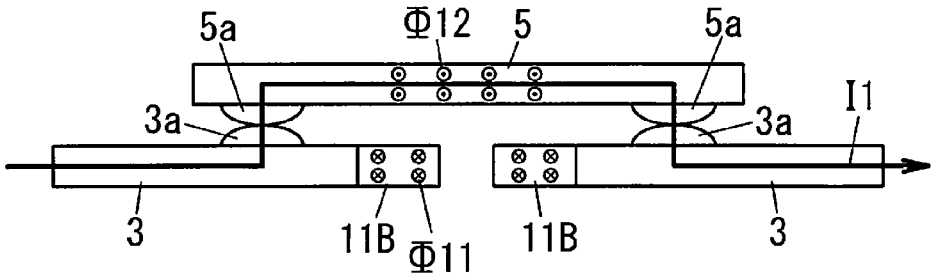
FIG. 3 is a front view illustrating a schematic configuration in the vicinity of a contact portion of another contact device according to the first embodiment.
Figure 4:
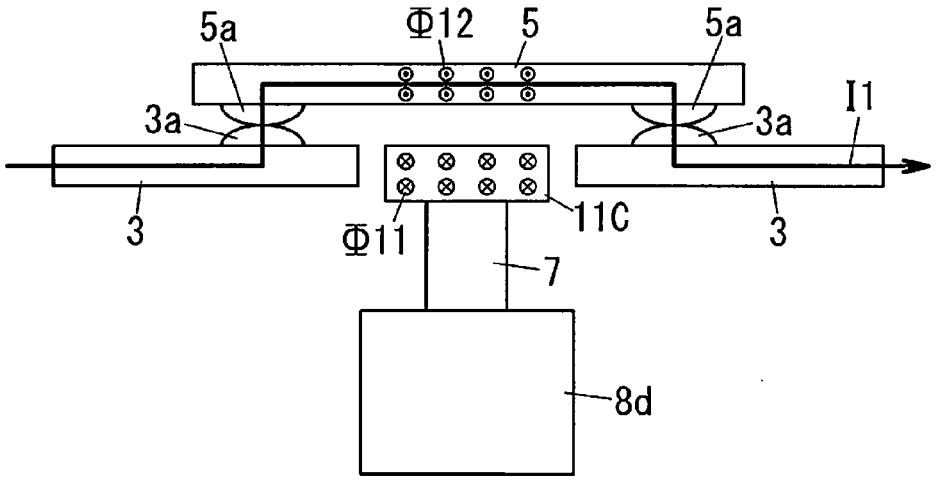
FIG. 4 is a front view illustrating a schematic configuration in the vicinity of a contact portion of yet another contact device according to the first embodiment.

Moreover, in order to disturb the balance of the magnetic field generated around the movable terminal 5, a yoke 11B (first yoke) shown in FIG. 3 or a yoke 11C (first yoke) shown in FIG. 4 may be used. The yoke 11B is formed in a tabular shape, and is provided integrally on the end faces of the pair of fixed holders 3 that are arranged opposite to each other. The yoke 11C is formed in a tabular shape, and is provided integrally on the upper end face of the movable shaft 7. The magnetic flux Φ11 that runs from the front to the back is mostly present in the yoke 11B or the yoke 11C, and the magnetic flux Φ11 that passes through the movable terminal 5 is reduced. Meanwhile, the magnetic flux Φ12 that runs from the back to the front is shifted downward as a whole, and the magnetic flux Φ12 that passes through the movable terminal 5 increases. Therefore, as in the case where the yoke 11A is used, the downward electromagnetic force that acts on the movable terminal 5 caused by the magnetic flux Φ12 becomes larger than the upward electromagnetic force that acts on the movable terminal 5 caused by the magnetic flux Φ11, and the similar effect may be attained. Note that, the first yoke of the present invention may be provided at the contact cover 1, and this case also may attain the similar effect as described above.

As described using FIGS. 1 and 2, the contact device A1 includes the movable core 8*d*, the stationary core 8*c*, the movable contacts 5*a*, the fixed contacts 3*a*, the movable terminal 5, and the movable shaft 7. The movable contacts 5*a* come in contact with the fixed contacts 3*a* by the movement of the movable core 8*d* in the direction for coming into contact with the stationary core 8*c*. In other words, the movable contacts 5*a* come in contact with the fixed contacts 3*a* by the movement of the movable core 8*d* toward the movable core 8*d* along the axis direction of the movable shaft 7. After the movable core 8*d* comes in contact with the stationary core 8*c*, the movable core 8*d* moves further in the direction for coming into contact with the stationary core 8*c*. In other words, after the movable core 8*d* comes in contact with the stationary core 8*c*, the movable core 8*d* moves further in the axis direction of the movable shaft 7. The movable shaft 7 moves in the axis direction of the movable shaft 7 along with the movement of the movable core 8*d*. The movable terminal 5 includes the movable contacts 5*a*. The contact device A1 includes the first yoke. The first yoke is made of a magnetic body. The first yoke is disposed between the movable terminal 5 and the movable shaft 7.

Moreover, the first yoke is disposed between the movable terminal 5 on which the movable contacts 5*a* are provided and the first end of the movable shaft 7. The first end face of the movable shaft 7 faces the movable terminal 5. The movable shaft 7 moves in the axis direction along with the movement of the movable core 8*d*.

Note that the fixed contacts 3*a* have one side and the other side. The one side of the fixed contacts 3*a* is defined as the first side of the fixed contacts 3*a*, and the other side of the fixed contacts 3*a* is defined as the second side of the fixed contacts 3*a*.

The movable terminal 5 is located at the first side relative to the fixed contacts 3*a*. The movable contacts 5*a* are configured so as to contact and separate from the fixed contacts 3*a*. The second end of the movable shaft 7 extends in the second side relative to the fixed contacts 3*a*.

Viewing this from another perspective, the movable shaft 7 has one end and the other end. The one end of the movable shaft 7 is defined as the first end, and the other end of the movable shaft 7 is defined as the second end. The first end of the movable shaft 7 is defined as the most proximate side relative to the fixed contacts 3*a*. The movable shaft 7 extends in the direction away from the fixed contacts 3*a* from the first end that is the most proximate to the fixed contacts 3*a*.

The contact device A1 includes the electromagnet device 8 and the pressing spring 6. The electromagnet device 8 includes the movable core 8*d* and the stationary core 8*c*.

The electromagnet device 8 is disposed on the second side relative to the movable shaft 7. In other words, seen from the movable shaft 7, the electromagnet device 8 is disposed at the same side with the other end of the movable shaft 7. In further other words, seen from the movable shaft 7, the electromagnet device 8 is disposed at the same side with the second end of the movable shaft.

The stationary core 8*c* is disposed on the second side relative to the movable core 8*d*. In other words, the stationary core 8*c* is arranged opposite to the movable terminal 5 with the movable core 8*d* interposing between them.

The electromagnet device 8 is configured to generate a magnetic attractive force between the stationary core 8*c* and the movable core 8*d*. The electromagnet device 8 moves the movable core 8*d* in the direction for coming into contact with the stationary core 8*c* by the magnetic attractive force. When the movable core 8*d* moves in the direction for coming into contact with the stationary core 8*c*, the movable shaft 7 moves in the direction in which the first end face of the movable shaft 7 separates from the movable terminal 5. The pressing spring 6 biases the movable terminal 5 in the direction in which the movable contacts 5*a* comes into contact with the fixed contacts 3*a*.

As shown in FIG. 2, the first yoke is provided at the movable terminal 5.

The first yoke is provided between the movable contacts 5*a*.

Note that the first yoke may be provided at a member on which the fixed contact 3*a* is formed. In one example, the member on which the fixed contact 3*a* is formed is the fixed holder 3 shown in FIG. 3.

The first yoke is disposed approximately at the center of the lower face of the movable terminal.

Note that, more preferably, the first yoke is disposed at the center of the lower face of the movable terminal.

Describing this from another perspective, the first yoke is disposed on the movable terminal so as to be located on the axis of the movable shaft.

Describing this from yet another perspective, the first yoke is disposed on the lower face of the movable terminal so as to be located on the axis of the movable shaft.

As shown in FIG. 3, a first yoke may be provided at the fixed holder 3. In other words, the first yoke may be provided at a member on which the fixed contact is formed.

The contact device has a plurality of first yokes.

The plurality of first yokes are provided at members on which the fixed contacts are formed so that each first yoke is equally distanced from the movable shaft.

Describing this from another perspective, the plurality of first yokes are provided at the members on which the fixed contacts are formed so that each first yoke is equally distanced from the center of the movable terminal.

As shown in FIG. 4, a first yoke may be provided at the movable shaft 7.

(Second Embodiment)

Figure 5A:
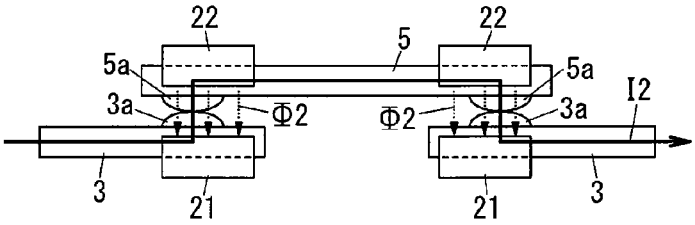
FIGS. 5(*a*) and 5(*b*) are front views illustrating a schematic configuration in the vicinity of a contact portion of a contact device according to a second embodiment.
Figure 5B:
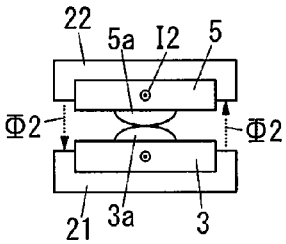

FIGS. 5(*a*) and 5(*b*) illustrate a yoke structure of a contact device A1 according to the present embodiment, and since the other structural elements of the present embodiment are similar to the first embodiment, their explanation will be omitted by providing the same reference sign to similar structural elements.

In the present embodiment, yokes 21 are provided at fixed holders 3, and yokes 22 are provided at a movable terminal 5. Note that the yokes 21 and 22 correspond to the first yoke of the present invention.

The yoke 21 has a U-shape cross-section, and is provided on the lower face of the fixed holder 3. The yoke 22 has a U-shape cross-section, and is provided on the upper face of the movable terminal 5. The yokes 21 and 22 are arranged opposite to each other in the up-down direction with the fixed contacts 3*a* and the movable contacts 5*a* interposing between them.

Thus, as shown in FIGS. 5(*a*) and 5(*b*), in a state in which a current flows between the fixed contacts 3*a* and the movable contacts 5*a*, a magnetic field is generated around the movable terminal 5 due to the current I2 flowing through the movable terminal 5, and a magnetic flux Φ2 that passes through the yokes 21 and 22 is generated. Thus, a magnetic attractive force in the up-down direction is generated between the yoke 21 and the yoke 22, and the yokes 22 are attracted by the yokes 21. As a result, a pressing force is generated between the fixed contacts 3*a* and the movable contacts 5*a*. Since this magnetic attractive force in the up-down direction is a force that acts in the direction that is 180 degree opposite to the repulsive force between contacts generated in the movable terminal 5, it acts in the direction in which the repulsive force between the contacts is most effectively canceled.

Thus, in the contact device A1 of this embodiment, even if a short circuit current flows between the fixed contacts 3*a* and the movable contacts 5*a*, the magnetic attractive force described above can effectively cancel out the repulsive force between the contacts, and accordingly the reduction of the pressing force between the contacts can be suppressed. Therefore, generation of an arc between the movable contacts 5*a* and the fixed contacts 3*a*, heat generation, and welding between contacts can be suppressed.

Figure 6:
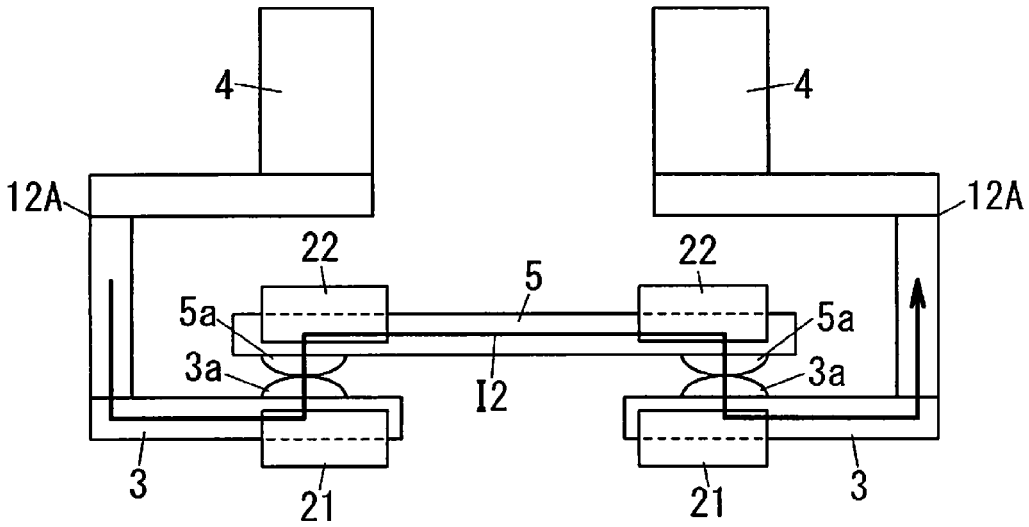
FIG. 6 is a front view illustrating a schematic configuration in the vicinity of a contact portion of another contact device according to the second embodiment.

A conduction plate that connects the fixed holder 3 and the terminal 4 may be a conduction plate 12A shown in FIG. 6 that has a substantially L-shape and that extends upward from the outer end portion of the fixed holder 3.

As described above, the first yoke is provided at a member on which the fixed contact 3*a* is formed. The first yoke is also provided at the movable terminal 5. Note that, in one example, the member on which the fixed contact 3*a* is formed is the fixed holder 3.

Accordingly, the reduction of the pressing force between the fixed contact and the movable contact can be suppressed.

"The first yoke provided at the member on which the fixed contact 3*a* is formed" is overlapped with "the first yoke provided at the movable terminal 5" in the axis direction of the movable shaft 7.

The first yoke provided at the member on which the fixed contact 3*a* is formed is overlapped with the fixed contact 3*a* in the axis direction of the movable shaft 7.

As shown in FIG. 5(*a*), the first yoke provided at the member on which the fixed contact 3*a* is formed is located at the opposite side from the fixed contact 3*a*.

Describing this from another perspective, the member on which the fixed contact 3*a* is formed has a holding face. The member on which the fixed contact 3*a* is formed holds the fixed contact 3*a* on the holding face. The first yoke provided at the member on which the fixed contact 3*a* is formed is located on a face that is opposite from the holding face.

The first yoke provided at the member on which the fixed contact 3*a* is formed is formed in a U-shape.

The member on which the fixed contact 3*a* is formed has a side face that crosses the holding face. The first yoke provided at the member on which the fixed contact 3*a* is formed is formed on the side face of the member on which the fixed contact 3*a* is formed.

More specifically, the first yoke provided at the member on which the fixed contact 3*a* is formed is formed on the holding face and the side face of the member on which the fixed contact 3*a* is formed.

More specifically, the first yoke provided at the member on which the fixed contact 3*a* is formed is formed on the holding face and both side faces of the member on which the fixed contact 3*a* is formed.

Moreover, a first yoke provided at the holding face of the member on which the fixed contacts 3*a* is formed is formed integrally with first yokes that are formed on the both side faces of the member on which the fixed contact 3*a* is formed. Thus, the first yoke is formed in a U-shape.

The first yoke provided at the movable terminal 5 overlaps with the movable contact 5*a* in the axis direction of the movable shaft 7.

As shown in FIG. 5(*a*), the first yoke provided at the movable terminal 5 is located at the opposite side from the movable contact 5*a*.

Describing this from another perspective, the movable terminal 5 has a supporting face. The movable terminal 5 holds the movable contact 5*a* on the supporting face. The first yoke provided at the movable terminal 5 is located on a face opposite from the supporting face.

The first yoke provided at the movable terminal 5 is formed in a U-shape.

The movable terminal 5 has a side face that crosses the supporting face. The first yoke provided at the movable terminal 5 is formed on the side face of the movable terminal.

More specifically, the first yoke provided at a member that is formed on the movable terminal 5 is formed on the supporting face and the side face of the movable terminal 5.

Furthermore specifically, the first yoke provided at the member that is formed on the movable terminal 5 is formed on the supporting face and both side faces of the movable terminal 5.

A first yoke provided at the supporting face of the movable terminal 5 is formed integrally with first yokes that are provided on both side faces of the movable terminal 5. Accordingly, the first yoke provided at the movable terminal 5 is formed in a U-shape.

Moreover, the members on which the fixed contacts 3*a* are formed are provided with a plurality of first yokes. The movable terminal 5 is provided with a plurality of first yokes.

The distances between the first yokes provided at the members on which the fixed contacts 3*a* are formed and the respective first yokes provided on the movable terminal 5 are set to be equal.

Moreover, the first yokes provided at the members on which the fixed contacts 3*a* are formed overlap with the first yokes provided at the movable terminal 5 in the axis direction of the movable shaft 7, respectively.

Note that the contact device of the present embodiment can be combined with the contact device of any of other embodiments.

(Third Embodiment)

Figure 7A:
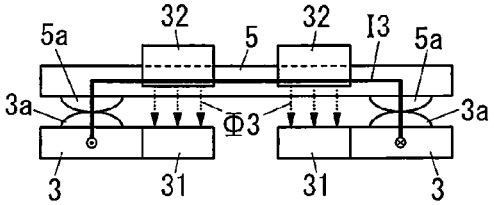
FIG. 7(*a*) is a front view illustrating a schematic configuration in the vicinity of a contact portion of a contact device according to a third embodiment, and FIG. 7(*b*) is a side view illustrating a schematic configuration in the vicinity of the contact portion of the contact device according to the third embodiment.
Figure 7B:
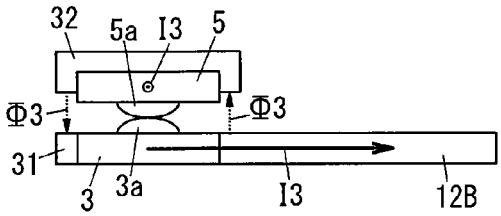

FIGS. 7(*a*) and 7(*b*) illustrate a yoke structure of a contact device A1 according to the present embodiment, and since the other structural elements of the present embodiment are similar to the first embodiment, their explanation will be omitted by providing the same reference sign to similar structural elements.

In the present embodiment, a conduction plate that connects a fixed holder 3 and a terminal 4 is a rectangular plate-shaped conduction plate 12B, and extends backward from the back end of the fixed holder 3.

Yokes 31 are provided at fixed holders 3, and yokes 32 are provided at a movable terminal 5. The yokes 31 are each formed in a tabular shape, and are provided integrally on the respective end faces of a pair of fixed holders 3 that face each other. The yokes 32 are each formed in a U-shaped cross-section, and are provided on the upper face of the movable terminal 5 that faces the yokes 31. Note that the yokes 31 and 32 correspond to the first yoke of the present invention.

Thus, as shown in FIGS. 7(*a*) and 7(*b*), in a state in which a current flows between fixed contacts 3*a* and movable contacts 5*a*, a magnetic field is generated around the movable terminal 5 due to the current I3 flowing through the movable terminal 5, and a magnetic flux Φ3 that passes through the yokes 21 and 22 is generated. Thus, a magnetic attractive force in the up-down direction is generated between the yokes 31 and the yokes 32, and the yokes 32 are attracted by the respective yokes 31. As a result, a pressing force is generated between the fixed contacts 3*a* and the movable contacts 5*a*. Since this magnetic attractive force in the up-down direction acts in the direction that is 180 degree opposite to the repulsive force between contacts generated in the movable terminal 5, it acts in the direction in which the repulsive force between contacts is most effectively canceled.

Thus, in the contact device A1 according to the present embodiment, even if a short circuit current flows between the fixed contacts 3*a* and the movable contacts 5*a*, the magnetic attractive force described above can effectively cancel out the repulsive force between the contacts, and accordingly the reduction of the pressing force between the contacts can be suppressed. Therefore, generation of an arc between the fixed contacts 3*a* and the movable contacts 5*a*, heat generation, and welding between contacts can be suppressed.

Note that the contact device of the present embodiment can be combined with the contact device of any of other embodiments.

(Fourth Embodiment)

Figure 8:
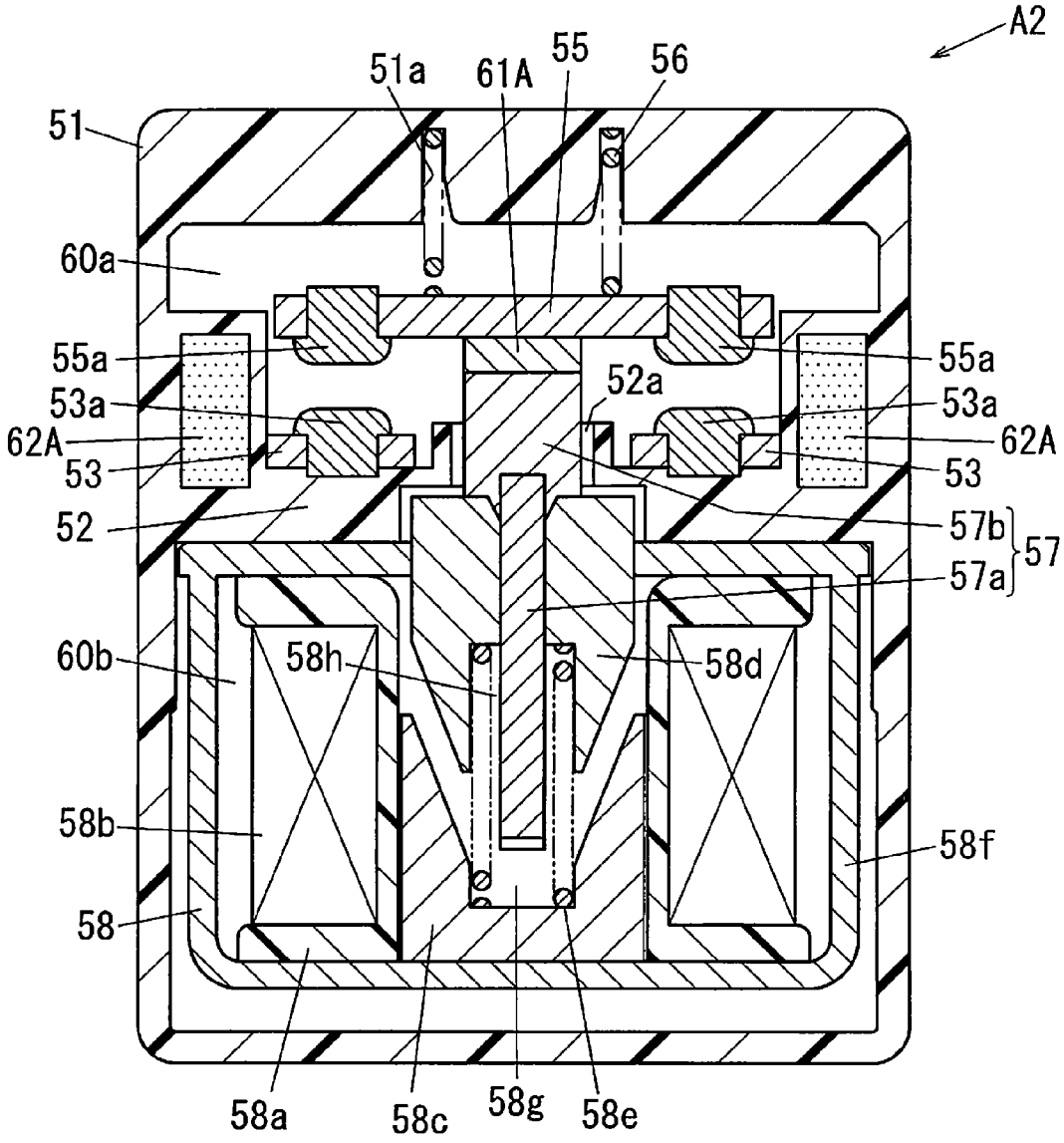
FIG. 8 is a cross-section illustrating a configuration of a contact device according to a fourth embodiment.
Figure 9:
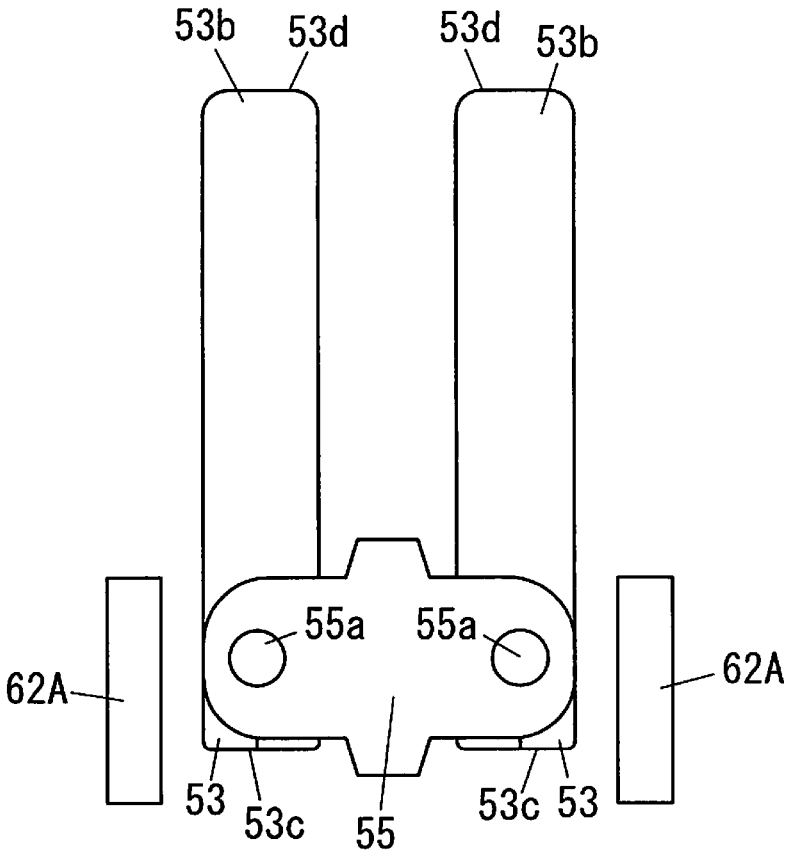
FIG. 9 is a top view illustrating a schematic configuration in the vicinity of a contact portion of the contact device according to the fourth embodiment.

FIGS. 8 and 9 illustrate a configuration of a contact device A2 according to the present embodiment. Note that, in the following description, the directions of up, down, left, right, front, and back are defined as in FIG. 8.

In the contact device A2, an outer wall is constituted by a box-shaped case 51 having a shape like a rectangular parallelepiped. A partition wall 52 for separating an upper portion and a lower portion is formed in the case 51, and thereby a contact space 60*a* of upper side and an electromagnet space 60*b* of lower side are separated from each other.

The contact space 60*a* accommodates fixed holders 53, a movable terminal 55, and a pressing spring 56.

A pair of fixed contacts 53*a* are provided on the upper faces of the fixed holders 53. The pair of fixed holders 53 are arranged side by side in the right-left direction, and thereby the pair of fixed contacts 53*a* are arranged side by side in the right-left direction. The pair of fixed holders 53 respectively have conduction plates 53*b* that extend backward. Each conduction plate 53*b* protrudes externally through the back face of the case 51, and is connected to an external circuit (not shown). That is to say, the conduction plates 53*b* extend in a direction perpendicular to the moving direction of the movable terminal 55. Note that "direction perpendicular to the moving direction of the movable terminal 55" also includes directions that are approximately perpendicular to the moving direction of the movable terminal 55.

Furthermore, a movable terminal 55 is disposed opposite to the upper face of the fixed holders 53. The movable terminal 55 is provided on its lower face with movable contacts 55*a* that face the pair of fixed contacts 53*a*. The case 51 has a toric recess 51*a* at the upper bottom face thereof. A pressing spring 56 is fitted in the recess 51*a* so that the lower end of the pressing spring 56 is in contact with the upper face of the movable terminal 55.

A yoke 61A (first yoke) is provided integrally at the movable terminal 55. The yoke 61A is made of a magnetic body, for example, a soft iron to have a tabular shape, and is provided approximately at the center of the lower face of the movable terminal 55 (between the pair of movable contacts 55*a*).

A bar shaped movable shaft 57 is disposed on the lower face of the yoke 61A. The movable shaft 57 extends downward between the pair of fixed holders 53. The movable shaft 57 is configured by providing a contact portion 57*b* on the upper end of the shaft body 57*a*. The contact portion 57*b* has a radius larger than that of the shaft body 57*a*. The movable shaft 57 is inserted through an insertion hole 52*a* that is provided approximately at the center of the partition wall 52. The upper face of the contact portion 57*b* faces the lower face of the yoke 61A, and an electromagnet device 58 is placed at the lower end side of the shaft body 57*a*.

The partition wall 52 separates the contact space 60*a* from the electromagnet space 60*b*, and has the function to prevent an abrasion powder in the contact space 60*a* from intruding into the electromagnet space 60*b*, and to prevent foreign objects in the electromagnet space 60*b* from intruding into the contact space 60*a*.

The electromagnet device 58 is configured by a coil bobbin 58*a*, a coil 58*b*, a stationary core 58*c*, a movable core 58*d*, a return spring 58*e*, and a heel piece 58*f*.

The coil bobbin 58*a* is made of an insulation member to have a shape like a cylinder tube, and the coil 58*b* is wound around its outer circumference. The stationary core 58*c*, the movable core 58*d*, and the return spring 58*e* are accommodated in the tube-shaped coil bobbin 58*a*, and the movable core 58*d* is disposed above the stationary core 58*c* so as to face the stationary core 58*c*. The shaft body 57*a* of the movable shaft 57 is inserted in and fixed to the movable core 58*d*, and the movable shaft 57 and the movable core 58*d* move integrally. A columnar recess 58*g* is formed at the upper face of the stationary core 58*c*, a columnar recess 58*h* is formed at the lower face of the movable core 58*d*, and respective ends of the return spring 58*e* are fitted in the recesses 58*g* and 58*h*. Furthermore, the outer face of the coil bobbin 58*a* is surrounded by the heal piece 58*f* made of a magnetic body. The stationary core 58*c* is disposed so that its lower face is in contact with the heal piece 58*f*.

Next, an operation of the contact device A2 will be described.

First, when no current is applied to the coil 58*b*, the movable core 58*d* has moved upward by the spring force of the return spring 58*e* against the spring force of the pressing spring 56, and has moved the movable terminal 55 upward through the movable shaft 57. At this time, the movable contacts 55*a* are kept out of contact from the fixed contacts 53*a*.

When current is applied to the coil 58*b* through a terminal (not shown) that is placed out of the case 51, the stationary core 58*c* is magnetized and functions to be an electromagnet, and accordingly a magnetic attractive force acts between the stationary core 58*c* and the movable core 58*d*. Thus, the movable core 58*d* moves in the direction for coming into contact with the stationary core 58*c* (downward) against the spring force of the return spring 58*e*. When the movable core 58*d* moves downward, since the force that presses the movable terminal 55 upward through the movable shaft 57 is relieved, the movable terminal 55 moves downward by the spring force of the pressing spring 56, and thereby the movable contacts 55*a* come in contact with the fixed contacts 53*a*. After the movable contacts 55*a* have come in contact with the fixed contacts 53*a*, the movable shaft 57 and the movable core 58*d* separate from the movable terminal 55, and move downward further until the lower end of the shaft body 57*a* comes in contact with the bottom portion of the recess 58*g* of the stationary core 58*c* and stops at this position. At this time, the movable contacts 55*a* are pressed toward the fixed contacts 53*a* by being subject to the spring force of the pressing spring 56.

When no more current is applied to the coil 58*b* and the attractive force of the electromagnet disappears, the movable core 58*d* moves in the direction for separating from the stationary core 58*c* (upward) by the spring force of the return spring 58*e*. In this time, the movable core 58*d* and the movable shaft 57 move upward together. The contact portion 57*b* of the movable shaft 57 then comes in contact with the lower face of the movable terminal 55, and thereafter the movable terminal 55 moves upward against the spring force of the pressing spring 56 and thereby the movable contacts 55*a* separate from the fixed contacts 53*a*. After separating from the fixed holders 53, the movable terminal 55 moves upward further by being pressed by the movable shaft 57 and stops.

In such contact device A2, the movable contacts 55*a* are made contact with the fixed contacts 53*a* by applying a current to the coil 58*b*. In this state, if a failure such as a short circuit or the like occurs between the conduction plates 53*b* that are brought out from the fixed contacts 53*a*, a short circuit current flows between the fixed contacts 53*a* and the movable contacts 55*a*. Therefore in such device, there is a concern that a pressing pressure between the movable contacts 55*a* and the fixed contacts 53*a* are reduced and the contacts are separated due to the electromagnetic repulsive force caused by this short circuit current, and that an arc may be generated between the fixed contacts 53*a* and the movable contacts 55*a*, and as a result heat is generated and the contacts are welded together.

Thus, in the present embodiment, the tabular yoke 61A made of a magnetic body is integrally provided approximately at the center of the lower face of the movable terminal 55. Therefore, the yoke 61A provided on the lower face of the movable terminal 55 disturbs the balance of the magnetic field generated around the movable terminal 55 in a state in which a current flows between the fixed contacts 53*a* and the movable contacts 55*a*. Therefore, the downward electromagnetic force that acts on the movable terminal 55 becomes larger than the upward electromagnetic force that acts on the movable terminal 55, and a similar effect as in the first embodiment can be attained.

Thus, in the contact device A2 of the present embodiment, even if a short circuit current flows between the fixed contacts 53*a* and the movable contacts 55*a*, the electromagnetic force described above can effectively cancel out the repulsive force between the contacts, and accordingly the reduction of the pressing force between the contacts can be suppressed. Therefore, generation of an arc between the fixed contacts 53*a* and the movable contacts 55*a*, heat generation, and welding between contacts can be suppressed.

Figure 10:
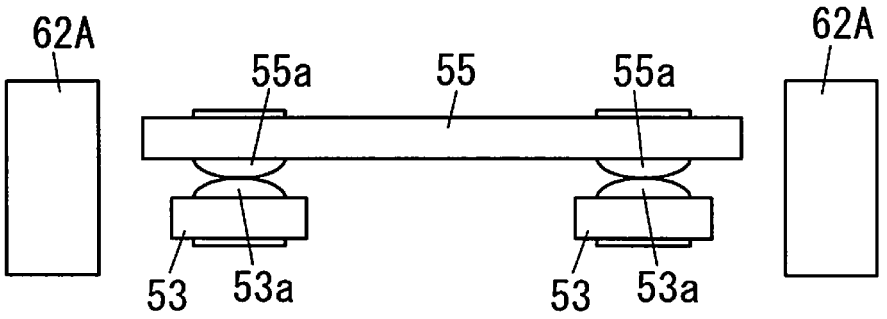
FIG. 10 is a front view illustrating a schematic configuration in the vicinity of the contact portion of the contact device according to the fourth embodiment.
Figure 11:
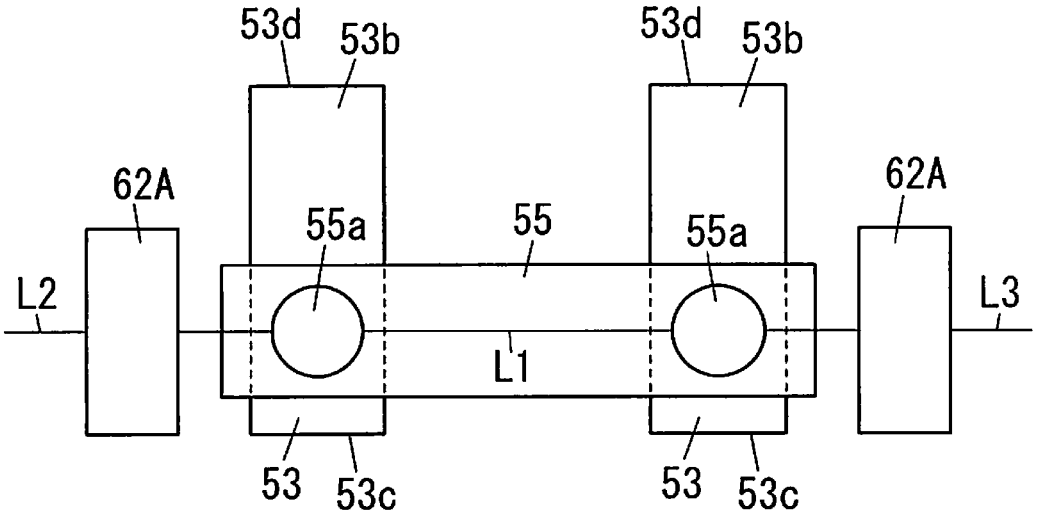
FIG. 11 is a top view illustrating a schematic configuration in the vicinity of the contact portion of the contact device according to the fourth embodiment.

Furthermore, in the contact device A2 of the present embodiment, the pair of fixed contacts 53*a* are arranged side by side in the right-left direction, and a pair of permanent magnets 62A that sandwich a pair of fixed contacts 53*a* therebetween in the right-left direction are embedded in the case 51 (see FIGS. 10 and 11). The permanent magnets 62A are provided to extinguish an arc in a short time, which may be generated between the fixed contact 53*a* and the movable contact 55*a* when the movable contact 55*a* separates from the fixed contact 53*a*.

The permanent magnets 62A are each formed in a rectangular plate shape, and are respectively arranged on extended lines L2 and L3 that extend in the right-left direction from both ends of a line segment L1 that connects a pair of fixed contacts 53*a* in the right-left direction, as shown in FIG. 11. The permanent magnets 62A are each magnetized in the thickness direction. The permanent magnets 62A are each disposed so that the longitudinal direction thereof is arranged along the front-back direction, the thickness direction thereof is arranged along the right-left direction, and like poles of them face each other. Each of the centers of the permanent magnets 62A in the front-back direction is located further to the side of the front edge 53*c* of the fixed holder 53 (tip of the fixed holder 53) from the center of the fixed contact 53*a* in the front-back direction.

An arc generated between contacts when the contacts are separated is stretched by the magnetic field that the permanent magnets 62A generate, and the arc can be extinguished in a short time.

For example, let us consider a case where the contact device A2 switches between conduction and cut-off of bidirectional currents whose magnitude differs, and a large current flows from the left to the right in the movable terminal 55 or a small current flows from the right to the left in the movable terminal 55, in FIGS. 10 and 11. If S poles of a pair of permanent magnets 62A are arranged opposite to each other, then an arc that is generated at the cut-off of the large current flowing from the left to the right in the movable terminal 55 is stretched toward (forward) the front end 53*c* of the fixed holder 53 (tip of the fixed holder 53). Moreover, an arc that is generated at the cut-off of the small current flowing from the right to the left in the movable terminal 55 is stretched toward (backward) the back end 53*d* of the conduction plate 53*b*.

Therefore, the travel distance of the end portion of an arc that is generated at the cut-off of a large current is up to the front ends 53*c* of the fixed holders 53 at the maximum, and the arc can be stretched enough and can be extinguished.

Meanwhile, the travel distance of the end portion of an arc that is generated at the cut-off of a small current is up to the back ends 53*d* of the conduction plates 53*b* at the maximum, the travel distance of the end portion of the arc is large, and it is difficult to stretch the arc largely. However, since it is relatively easy to extinguish an arc that is generated at the cut-off of a small current, the arc can be extinguished even when the stretching quantity thereof is small.

Note that, in a case where the N poles of a pair of permanent magnets 62A are arranged opposite to each other, the direction in which an arc is stretched is reversed from the direction described above.

In the present embodiment, the center of the permanent magnet 62A in the front-back direction is located further to the front side from the center of the fixed contact 53*a*. This kind of configuration is effective in the case where an arc, which is generated at the cut-off of a large current, is stretched forward, in a contact device in which bidirectional currents, whose magnitude differ, are switched between conduction and cutoff. Specifically, an arc that is generated at the cut-off of a large current can be stretched forward effectively, and in addition, the permanent magnets 62A can be downsized.

Moreover, even in a case where a pair of permanent magnets 62A are arranged so that the different poles are arranged opposite to each other, an arc generated between the contacts when the contacts are separated is stretched by the magnetic field that the permanent magnets 62A generate, and the arc can be extinguished in a short time.

For example, in FIGS. 10 and 11, if an N pole of the left permanent magnet 62A and an S pole of the right permanent magnet 62A are arranged opposite to each other, and a current flows from the left to the right in the movable terminal 55, the situation will be as follows. That is, the arc generated between the left contacts is stretched toward the back end 53*d* of the conduction plate 53*b* (backward), and the arc generated between the right contacts is stretched toward the front end 53*c* of the fixed holder 53 (forward). Note that, if a current flow from the right to the left in the movable terminal 55, the arc generated between the left contacts is stretched toward the front end 53*c* of the fixed holder 53 (forward), and the arc generated between the right contacts is stretched toward the back end 53*d* of the conduction plate 53*b* (backward). Note that if the poles of the pair of permanent magnets 62A that are arranged opposite to each other are switched, the direction in which the arc is stretched is reversed to the direction described above.

As described above, as shown in FIGS. 8 and 9, the contact device A1 includes a pair of permanent magnets 62A. The contact device A1 includes a plurality of fixed contacts 3*a*. The plurality of fixed contacts 3*a* are arranged side by side. The direction in which the plurality of fixed contacts 3*a* are arranged is defined as the direction of side by side arrangement. The permanent magnets 62A are respectively arranged on extended lines that extend from both ends of a line segment that connects the pair of the fixed contacts 3*a* located at the both ends in the direction of side by side arrangement.

Accordingly, an arc generated between the fixed contact and the movable contact can be extinguished in a short time.

Note that the contact device of the present embodiment can be combined with the contact device of any of other embodiments.

(Fifth Embodiment)

Figure 12:
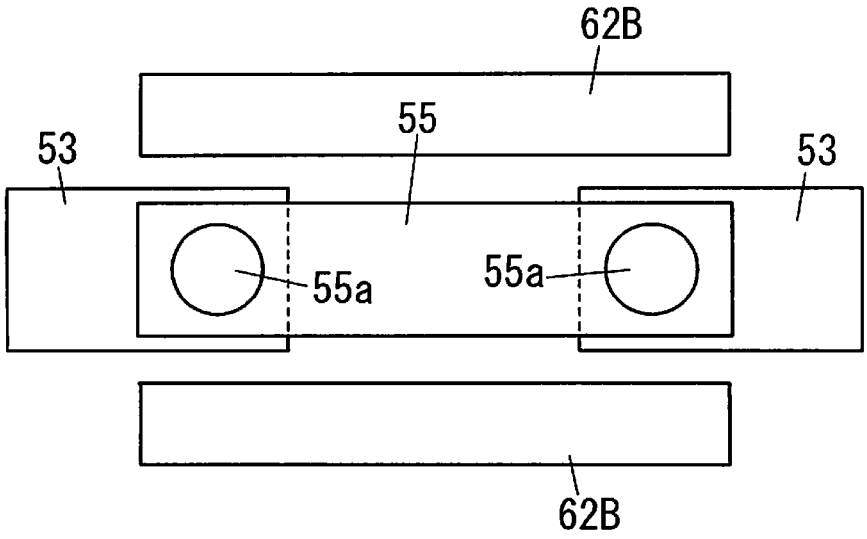
FIG. 12 is a top view illustrating a schematic configuration in the vicinity of a contact portion of a contact device according to a fifth embodiment.

FIG. 12 illustrates a structure for extinguishing an arc of a contact device A2 according to the present embodiment, and since the other structural elements of the present embodiment are similar to the fourth embodiment, their explanation will be omitted by providing the same reference sign to similar structural elements.

The present embodiment includes a pair of permanent magnets 62B that sandwich a pair of fixed contacts 53*a* therebetween in a front-back direction, and the pair of permanent magnets 62B are each formed in an elongated tabular shape, in which the longitudinal direction thereof is arranged along the right-left direction. In other words, a pair of permanent magnets 62B that are arranged opposite to each other with a pair of fixed contacts 53*a* sandwiching therebetween are formed along the right-left direction.

The pair of permanent magnets 62B are each magnetized in the thickness direction (front-back direction). An arc generated between contacts when the contacts are separated is stretched by the magnetic field that the permanent magnets 62B generate, and the arc can be extinguished in a short time.

For example, in FIG. 12, in a configuration in which a current flows from the left to the right in a movable terminal 55, S poles of the pair of permanent magnets 62B are arranged opposite to each other. In this case, an arc generated between the left contacts is stretched backward to the left, and an arc generated between the right contacts is stretched backward to the right. In a configuration in which current flows from the right to the left in the movable terminal 55, N poles of the pair of permanent magnets 62B are arranged opposite to each other. In this case, an arc generated between the left contacts is stretched backward to the left, and an arc generated between the right contacts is stretched backward to the right.

Note that, a pair of permanent magnets 62B may be arranged so that the different poles face each other.

Note that, a pair of permanent magnets 62B each may be magnetized in the longitudinal direction (right-left direction).

As described above, in the contact device A1 in FIG. 12, a plurality of fixed contacts 3*a* are arranged side by side. The direction in which the plurality of fixed contacts 3*a* are arranged is defined as the direction of side by side arrangement. The contact device A1 has a pair of permanent magnets 62B. The permanent magnets 62B are arranged to sandwich the fixed contacts 3*a* therebetween. In other words, the permanent magnets 62B are arranged so that the fixed contacts

3*a* are located therebetween. The permanent magnets 62B are formed along the direction of side by side arrangement.

Accordingly, an arc generated between the fixed contact and the movable contact can be extinguished in a short time.

Note that the contact device of the present embodiment can be combined with the contact device of any of other embodiments.

(Sixth Embodiment)

Figure 13:
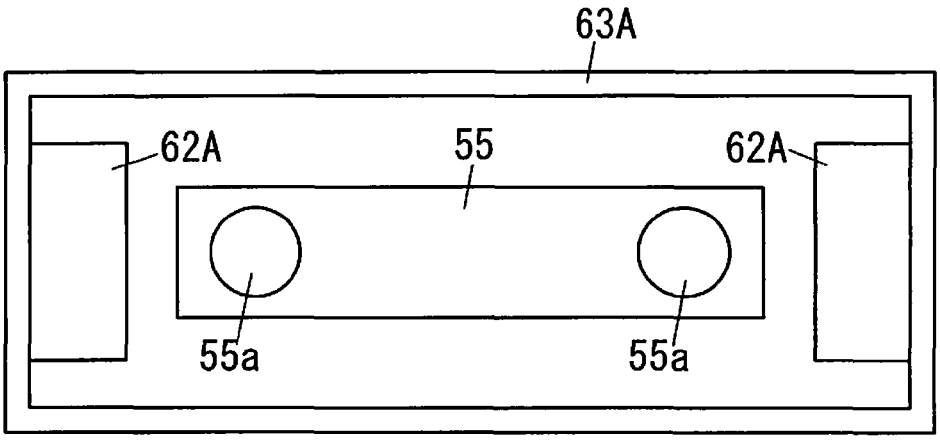
FIG. 13 is a top view illustrating a schematic configuration in the vicinity of a contact portion of a contact device according to a sixth embodiment.

FIG. 13 illustrate a structure for extinguishing an arc of a contact device A2 according to the present embodiment, and since the other structural elements of the present embodiment are similar to the fourth embodiment, their explanation will be omitted by providing the same reference sign to similar structural elements.

The present embodiment includes a yoke 63A (second yoke) that magnetically connects a pair of permanent magnets 62A. The yoke 63A is formed in a rectangular frame shape, and permanent magnets 62A are arranged respectively on in-sides of a pair of short sides of the yoke 63A that are opposite to each other. The yoke 63A forms a magnetic circuit along with the pair of permanent magnets 62A. Since the magnetic flux generated by the pair of permanent magnets 62A is attracted by the yoke 63A, and a leaked magnetic flux is suppressed, the magnetic flux density in the vicinity of the contact can be improved and a force to stretch an arc generated between the contacts is increased. Accordingly, due to providing the yoke 63A, a force to stretch an arc can be maintained even when the size of the permanent magnets 62A is decreased, and as a result, downsizing and cost reduction of a contact device is possible while maintaining the arc cut-off performance.

Note that the contact device of the present embodiment can be combined with the contact device of any of other embodiments.

(Seventh Embodiment)

Figure 14:
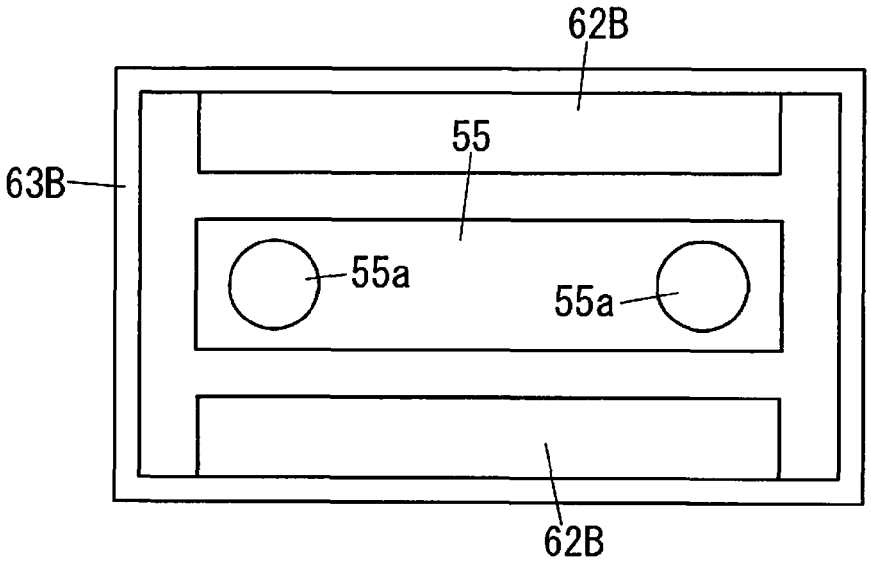
FIG. 14 is a top view illustrating a schematic configuration in the vicinity of a contact portion of a contact device according to a seventh embodiment.
Figure 15:
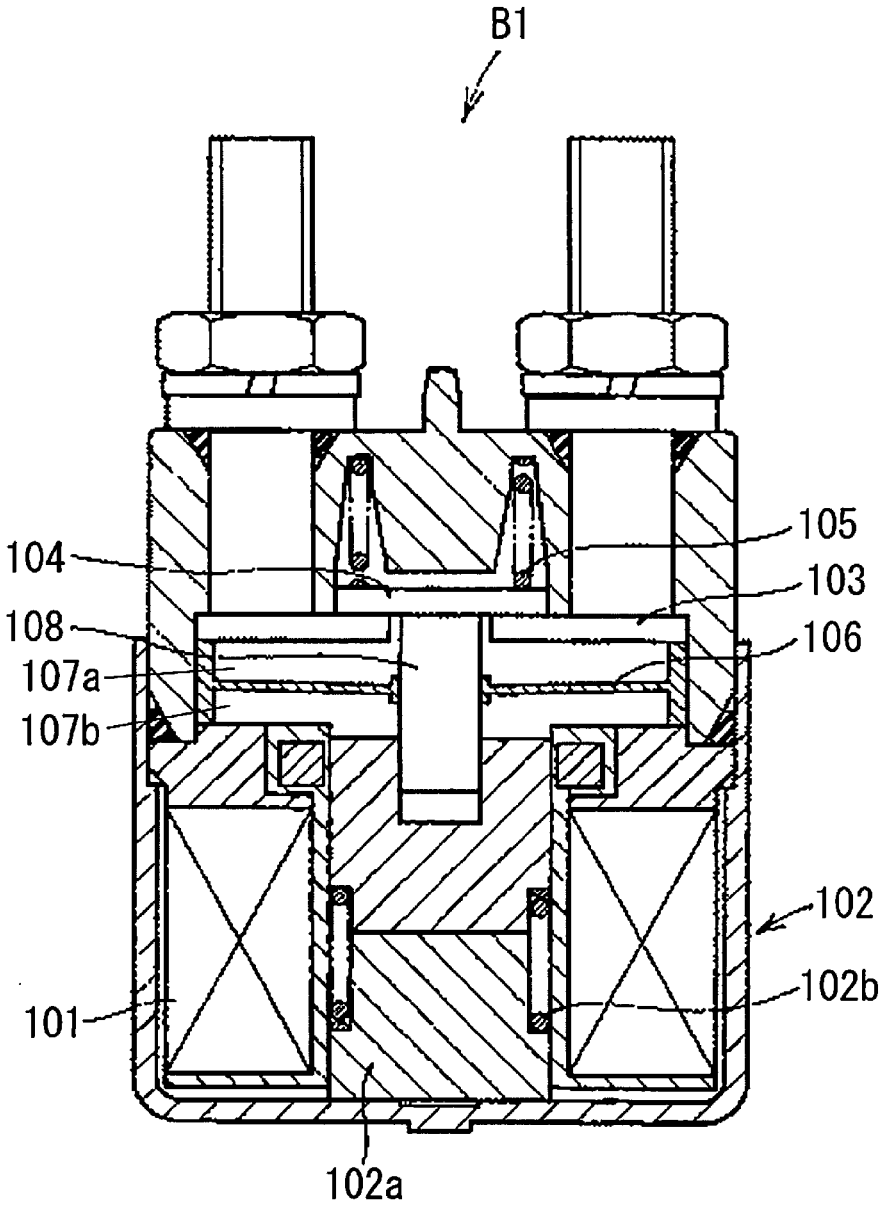
FIG. 15 Prior Art
FIG. 15 is a cross-section illustrating a configuration of a conventional contact device.
Figure 16:
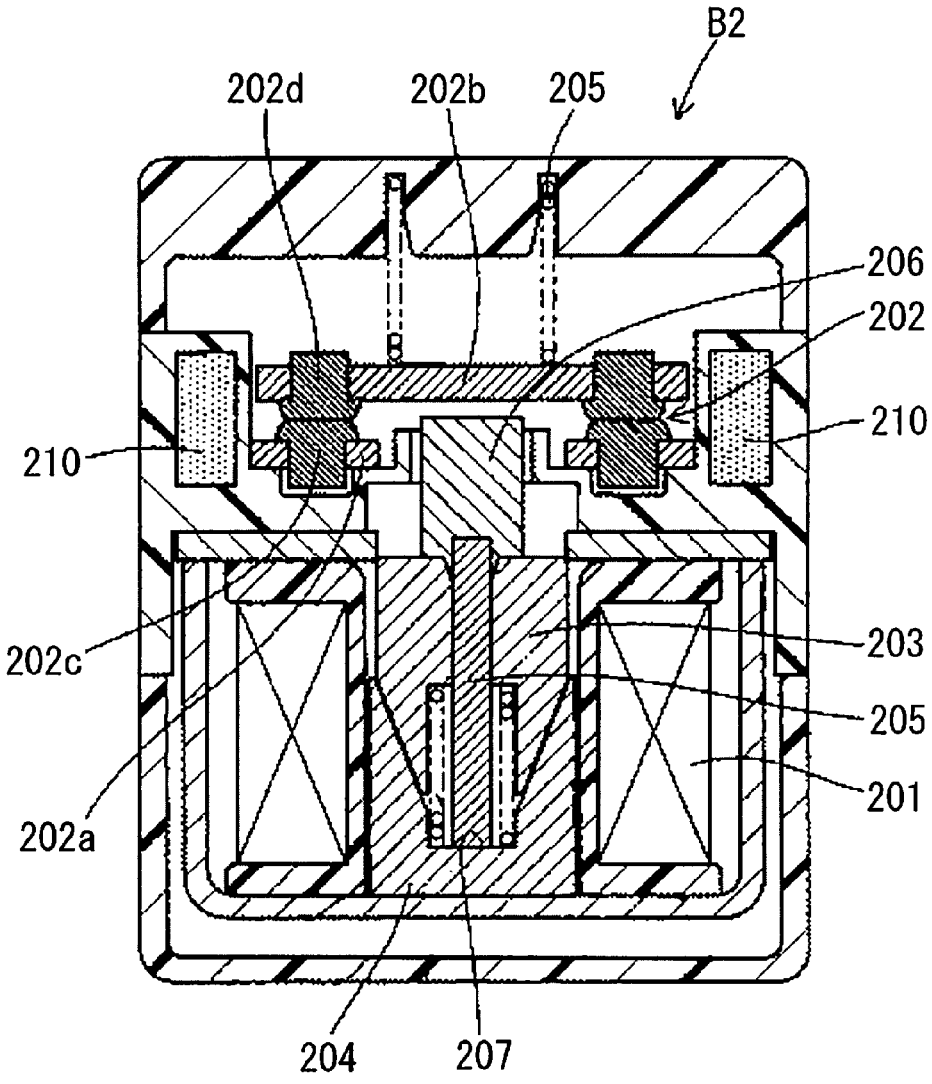
FIG. 16 Prior Art
FIG. 16 is a cross-section illustrating a configuration of another conventional contact device.

FIG. 14 illustrate a structure for extinguishing an arc of a contact device A2 according to the present embodiment, and since the other structural elements of the present embodiment are similar to the fifth embodiment, their explanation will be omitted by providing the same reference sign to similar structural elements.

The present embodiment includes a yoke 63B (second yoke) that magnetically connects a pair of permanent magnets 62B. The yoke 63B is formed in a rectangular frame shape, and permanent magnets 62B are respectively arranged on in-sides a pair of long sides of the yoke 63B that are opposite to each other. The yoke 63B forms a magnetic circuit along with the pair of permanent magnets 62B. Since the magnetic flux generated by the pair of permanent magnets 62B is attracted by the yoke 63B, and a leaked magnetic flux is suppressed, the magnetic flux density in the vicinity of the contact can be improved and a force to stretch an arc generated between the contacts is increased. Accordingly, due to providing the yoke 63B, a force to stretch an arc can be maintained even when the size of the permanent magnets 62B is decreased, and as a result, downsizing and cost reduction of a contact device is possible while maintaining the arc cut-off performance.

Note that in any of the first the third embodiments, a permanent magnet may be provided in order to extinguish in a short time an arc that is generated between contacts when contact is opened, similar to the fourth to the seventh embodiments.

Moreover, in the fourth to the sixth embodiments, in order to disturb the balance of a magnetic field that is generated around the movable terminal 55, a configuration that is similar to the yoke 11B shown in FIG. 3 that is provided in the fixed holder 3, or the yoke 11C shown in FIG. 4 that is provided at the movable shaft 7 may be used, as substitute for the yoke 61A. Moreover, a configuration similar to the yokes 21 and 22 that are provided at both the fixed holders 3 and the movable terminal 5 shown in FIG. 5 may be used.

Note that the contact device of the present embodiment can be combined with the contact device of any of other embodiments.

Note that the contact device in each embodiment described above may be provided, for example, in a DC current path that supplies electric power to an electric motor and the like for travelling a vehicle from a battery mounted on the vehicle, and may be used for the purpose of turning on and cut-off the DC current path. However, the contact device according to each embodiment described above is not limited to this application, and may also be used in an AC current path or in a current path other than in a vehicle.

REFERENCE SIGNS LIST

A1 Contact device
3 Fixed holder
3*a* Fixed contact
5 Movable terminal
5*a* Movable contact
6 Pressing spring
7 Movable shaft
8 Electromagnet device
8*b* Coil
8*c* Stationary core
8*d* Movable core
11A Yoke (first yoke)

The invention claimed is:

1. A contact device, wherein the contact device is configured so that a movable core, after a movable contact comes in contact with a fixed contact by moving the movable core in a direction for coming into contact with a stationary core, moves further in the direction for coming into contact with the stationary core, and a first yoke made of a magnetic body is provided at a member on which the fixed contact is formed.

2. The contact device according to claim 1, further comprising:

a movable terminal on which the movable contact is provided; and a movable shaft that moves in an axis direction along with movement of the movable core, wherein:

the movable terminal is located at a first side relative to the fixed contact so that the movable contact contacts and separates from the fixed contact, a first end of the movable shaft faces the movable terminal, a second end of the movable shaft extends in a second side relative to the fixed contact, and the contact device comprises:

an electromagnet device that includes the movable core located at the second side relative to the movable shaft, and the stationary core located at the second side relative to the movable core, the electromagnet device being configured to move the movable shaft in a direction in which a face of the first end of the movable shaft separates from the movable terminal by generating a magnetic attractive force between the stationary core and the movable core to move the movable core in the direction for coming into contact with the stationary core; and a pressing spring that biases the movable terminal in a direction in which the movable contact comes into contact with the fixed contact.

3. The contact device according to claim 1, further comprising a movable terminal on which the movable contact is provided, wherein the first yoke includes first yokes provided at a member on which the fixed contact is formed and at the movable terminal.

4. The contact device according to claim 1, further comprising a movable terminal on which the movable contact is provided, wherein the fixed contact is connected to a conduction plate that extends in a same direction as a moving direction of the movable terminal.

5. The contact device according to claim 1, further comprising a movable terminal on which the movable contact is provided, wherein the fixed contact is connected to a conduction plate that is extended in a direction that is perpendicular to a moving direction of the movable terminal.

6. The contact device according to claim 1, wherein the fixed contact includes fixed contacts arranged side by side, and the contact device comprises a pair of permanent magnets that are respectively arranged on extended lines extending from both ends of a line segment that connects a pair of fixed contacts located at two ends of this side by side arrangement of the fixed contacts.

7. The contact device according to claim 1, wherein the fixed contact includes fixed contacts arranged side by side, and a pair of permanent magnets that are arranged opposite to each other with the fixed contacts sandwiching therebetween are formed along a direction of side by side arrangement of the fixed contacts.

8. The contact device according to claim 7, wherein same poles of the pair of permanent magnets oppose each other.

9. The contact device according to claim 6, comprising a second yoke made of a magnetic body that magnetically connects the pair of permanent magnets.

10. The contact device according to claim 7, comprising a second yoke made of a magnetic body that magnetically connects the pair of permanent magnets.

* * * * *